United States Patent [19]

Husslein

[11] 4,158,127

[45] Jun. 12, 1979

[54] STOVE TOP

[75] Inventor: Julius Husslein, Vachendorf, Fed. Rep. of Germany

[73] Assignee: Bosch-Siemens Hausgeräte GmbH, Munich, Fed. Rep. of Germany

[21] Appl. No.: 854,266

[22] Filed: Nov. 23, 1977

[30] Foreign Application Priority Data

Nov. 24, 1976 [DE] Fed. Rep. of Germany ..... 2653389

[51] Int. Cl.[2] ..... H05B 3/68

[52] U.S. Cl. ..... 219/446; 219/218; 219/464; 219/466; 219/480

[58] Field of Search ..... 219/218, 443, 444, 445, 219/446, 447, 451, 499, 464, 466, 476, 477, 478, 479, 480; 99/374, 389

[56] References Cited

U.S. PATENT DOCUMENTS

| | | | |
|---|---|---|---|
| 791,708 | 6/1905 | Matcovitch | 219/445 |
| 1,346,793 | 7/1920 | Bummell et al. | 219/464 X |
| 2,439,133 | 4/1948 | Jenkins | 219/218 |
| 2,786,929 | 3/1957 | Michaels | 219/449 |
| 3,525,852 | 8/1970 | Filipak | 219/444 |
| 3,632,982 | 1/1972 | Linger | 219/447 |

*Primary Examiner*—Volodymyr Y. Mayewsky
*Attorney, Agent, or Firm*—Herbert L. Lerner

[57] ABSTRACT

A range top having a plurality of main cooking stations defining discrete cooking areas spaced from one another and being switchable on and off by switching elements individually connectible to the main cooking stations, includes an auxiliary cooking station disposed in vicinity of at least one of the main cooking stations and being conformed to and contiguous with the one main cooking station so as to define therewith a substantially continuous enlarged cooking area.

6 Claims, 1 Drawing Figure

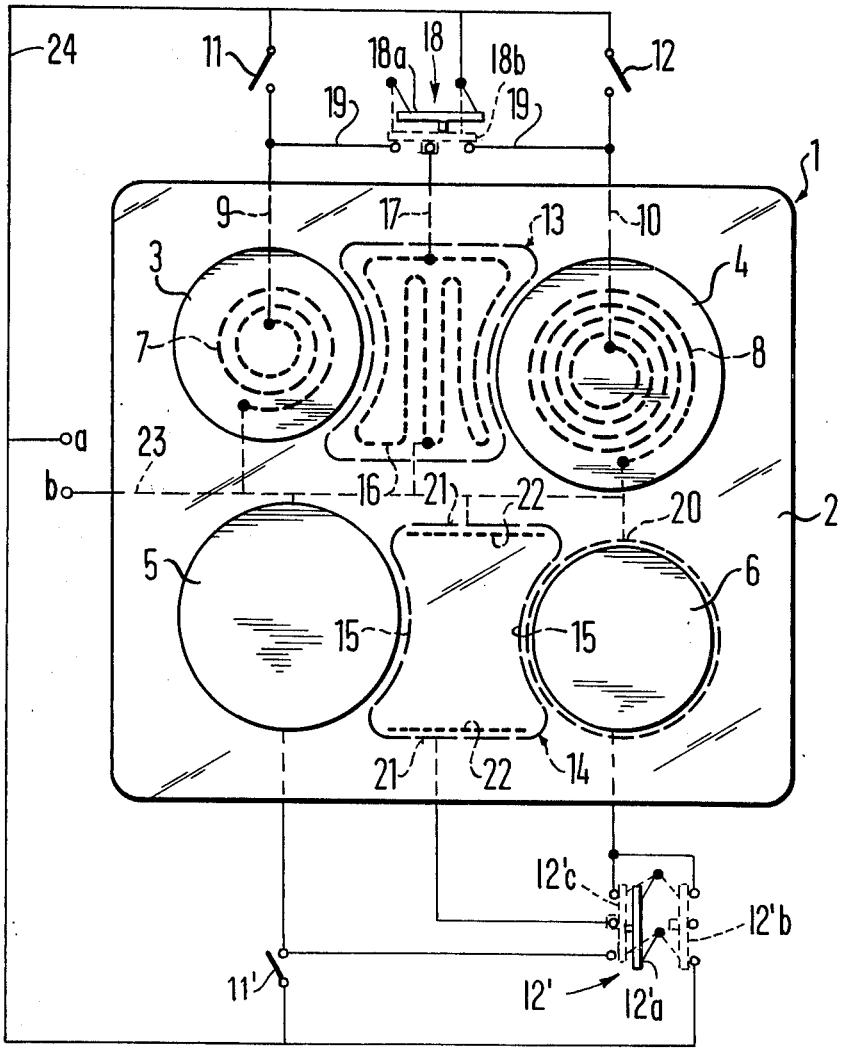
24
11
18a
18
18b
12
19
19
1
9
17
13
10
3
4
7
8
a
23
b
16
21
22
20
2
5
6
15
15
21
22
14
12'c
12'b
11'
12'
12'a

STOVE TOP

The invention relates to a stove or range top with a support plate having several main cooking stations which are located spaced from one another and are switchable on and off individually by main switching means associated with the cooking stations.

In such range tops, wherein, for example, four cooking plates of basically round shape are disposed on a support plate or wherein heater windings forming separate cooking stations are disposed underneath a solid or stable glass plate, the conventionally circular cooking zone is clearly delineated. Cooking stations of different areas, for example, having different diameters of the respective curcular shapes thereof, are provided for different pot sizes. In the case of special cooking pots, however, such as basically elongated or oval-shaped pots or pans for fish or fowl, considerable difficulties are encountered, since individual cooking stations are usually too small, and two adjacent round cooking stations are spaced too far apart from one another.

In a heretofore known electrically heated range top as is described in German Pat. No. DT-AS 23 55 412, heating resistors formed of cold-conductor material with a step-function characteristic are distributed over the area of the range top and divided into zones of varying energy density and/or varying transition temperature of the cold-conductors. The different zones forming varying power stages can be switched on and off individually. What is supposed to be achieved by this heretoforeknown construction is the heating of the range top at least to a great extent, over the entire surface thereof.

In contrast thereto, it is an object of the invention of the instant application to provide a range top of the aforementioned type wherein several separate, individual cooking stations having discrete cooking areas are provided for heating normal cooking pots in a conventional manner, yet the foregoing difficulties are avoided by providing that these cooking stations be expansible into larger composite cooking areas if required.

With the foregoing and other objects in view, there is provided, in accordance with the invention, in a range top having a plurality of main cooking stations defining discrete cooking areas spaced from one another and being switchable on and off by switching elements individually connectible to the main cooking stations, an auxiliary cooking station disposed in vicinity of at least one of the main cooking stations and being conformed to and contiguous with the one main cooking station so as to define therewith a substantially continuous enlarged cooking area.

In accordance with another feature of the invention, the auxiliary cooking station is disposed between two of the main cooking stations, the cooking areas of the two main cooking stations having a circular shape, and the auxiliary cooking station defining a cooking area having respective substantially concave sides corresponding to the circular shape of the cooking areas of the two main stations and defining therewith an elongated composite cooking surface.

In accordance with a further feature of the invention, the cooking area of the auxiliary cooking station has additional sides extending from one to the other of the substantially concave sides thereof, the auxiliary cooking station having heating devices concentrated at the additional sides of the cooking area thereof. In this manner, it is possible at all times to produce from a normal, for example circular, main cooking station and a supplemental or auxiliary cooking station conforming to the main cooking station, or from two normal main cooking stations and an auxiliary or supplemental cooking station disposed therebetween, a relatively large composite cooking area which is suited for heating larger, for example oval, pots of specialized type. It is possible within the scope of the invention to employ, for the main cooking stations and/or the auxiliary or supplemental cooking stations, cooking plates which are disposed on a support plate, or to provide, underneath a support plate, preferably a solid or stable-glass plate, suitably shaped heating resistances or induction coils for inductively heating the cooking pots disposed on the support plate.

In accordance with an additional feature of the invention, there is provided another auxiliary cooking station having the shape of at least part of a ring and at least partly surrounding one of the main cooking stations. In this manner, a cooking station of basically circular shape can be adapted to cooking pots of varying diameters, as required.

In accordance with yet another feature of the invention, there is provided a supplemental switch element connected in common to the main and the auxiliary cooking stations for simultaneously switching-on and switching-off the main and the auxiliary cooking stations whereby the substantially continuous enlarged cooking area defined thereby is selectively rendered fully effective and ineffective, respectively. When the common supplemental or auxiliary switching element is operated, the main switching means assigned to the individual cooking stations are shorted. Only one handle is then necessary for switching on and off the enlarged cooking surface formed of two or more cooking stations and at least one supplemental cooking station.

In accordance with a concomitant feature of the invention, at least one of the switching elements has a switch position wherein the main cooking stations and the auxiliary cooking station are switchable on and off in common whereby the substantially continuous enlarged cooking area defined by the main cooking stations and the auxiliary cooking station is selectively rendered fully effective and ineffective, respectfully.

Other features which are considered as characteristic for the invention are set forth in the appended claims.

Although the invention is illustrated and described herein as embodied in a range top, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single FIGURE of the drawing which is a diagrammatic and schematic top plan view of the range top of the invention.

Referring now to the FIGURE of the drawing, there is shown a substantially square-shaped range or cooking top 1, having a support plate 2 formed, for example, of stable-glass. Located on the support plate 2 are four main cooking plates of basically circular shape, forming main cooking stations 3, 4, 5 and 6. The main cooking stations 3 and 6 have a small diameter of, for example, 154 mm, while the larger-area main cooking stations 4 and 5 have a diameter, for example, of 189 mm. In the main cooking stations 3 and 4, the resistance heating wires 7 and 8, shown diagrammatically, are connected by means of electrical leads 9 and 10 to manually actuatable main switching elements 11 and 12, respectively, and can be connected to and disconnected from the power line accordingly. Corresponding switching elements 11' and 12' are associated with the other main cooking stations 5 and 6.

In the plate regions between the main cooking stations 3 and 4 and between the main cooking stations 5 and 6, supplemental or auxiliary cooking stations 13 and 14, respectively, are disposed. The auxiliary cooking stations are indicated by broken lines and the basic shape thereof is conformed to the circular shape of the two cooking stations 3, 4, on the one hand, and 5, 6, on the other hand, associated therewith. These auxiliary cooking stations have correspondingly inwardly drawn, concave side sections 15 and supplement the two main cooking stations. For example, the main cooking stations 3, 4, on the one hand, and 5, 6, on the other hand, form with the respective auxiliary cooking stations 13 and 14, large-area or elongated composite cooking areas 3, 4, 13 and 5, 6, 14, respectively. In the auxiliary cooking station 13, a heating device formed of a resistance heating wire 16 is again shown diagrammatically. It is connected by means of a line 17 to a supplemental switching element such as a triple pole, single throw switch 18. The supplemental switching element 18 is also connectible by means of line sections 19 to the lines 9 and 10 of the main cooking stations 3 and 4, respectively, in such a manner that, if the entire composite cooking area 3, 4, 13 is to be rendered effective, only the supplemental switching element 18 needs to be actuated so as to connect jointly the heating elements 7 and 8 of the main cooking stations 3 and 4 with the heating elements 16 of the auxiliary cooking station 13 to the power line, for example, through a temperature control of conventional design. When the supplemental switch 18 is used, the main switching elements 11 and 12 are shorted out.

The cooking stations may also be wired so that only the one main cooking station 3 or 4 is operable with a supplemental cooking station 13 to provide the desired combined cooking area.

The cooking station 6 is provided with an annular auxiliary cooking station 20, by which the main cooking station 6 can be enlarged. The auxiliary cooking station 20 may be shaped as a complete ring or as a segment of a ring at least partly surrounding the main cooking station.

As illustrated in the FIGURE of the drawing, at the auxiliary cooking station 14, heating devices 22, e.g., heater windings, are concentrated in the two outer boundary areas thereof 21 between the circular main cooking stations 5 and 6.

In accordance with a variation of the switching system, and within the scope of the invention, as shown at the bottom of the FIGURE, one of the main switching elements 11' and 12', namely the switching element 12', such as a triple pole, double throw switch, is switchable between a position in which only the main cooking station 6 is switched on, and a switch position in which all heating devices of the enlarged composite heating area 5, 6, 14 are switched on, without requiring a supplemental joint switching element 18 as in the switching system illustrated at the top of the FIGURE. On the other hand, the other main switching element 11' serves solely for switching on the main cooking station 5.

There are claimed:

1. In a range top having a plurality of main electrical cooking stations having electrical heating devices and defining discrete cooking areas spaced from one another and being switchable on and off by electrical switching elements individually connectible to the main cooking station through an electrical circuit, an auxiliary electrical cooking station having an electrical heating device and being disposed in vicinity of at least one of said main cooking stations and being conformed to and contiguous with said one main cooking station so as to define therewith a substantially continuous enlarged cooking area, said auxiliary cooking station being switchable on and off with said at least one of said main cooking stations by said electrical switching elements through said electrical circuit.

2. Range top according to claim 1 wherein said auxiliary cooking station is disposed between two of said main cooking stations, said cooking areas of said two main cooking stations having a circular shape, and said auxiliary cooking station defining a cooking area having respective substantially concave sides corresponding to the circular shape of said cooking areas of said two main cooking stations and defining therewith an elongated composit cooking surface.

3. Range top according to claim 2 wherein said cooking area of said auxiliary cooking station has additional sides extending from the one to the other of said substantially concave sides thereof, said heating devices in said auxiliary cooking station being concentrated at said additional sides of said cooking area thereof.

4. Range top according to claim 1 including another auxiliary cooking station having the shape of at least part of a ring and at least partly surrounding one of said main cooking stations.

5. Range top according to claim 1 including a supplemental switching element connected in common to said main and said auxiliary cooking stations for simultaneously switching-on and switching-off said main and said auxiliary cooking stations whereby said substantially continuous enlarged cooking area defined thereby is selectively rendered fully effective and ineffective, respectively.

6. Range top according to claim 1 wherein at least one of said switching elements has a switch position wherein said main cooking stations and said auxiliary cooking station are switchable on and off in common whereby said substantially continuous enlarged cooking area defined by said main cooking stations and said auxiliary cooking station is selectively rendered fully effective and ineffective, respectively.

* * * * *